US008903228B2

(12) United States Patent
Goodman et al.

(10) Patent No.: US 8,903,228 B2
(45) Date of Patent: Dec. 2, 2014

(54) VAPOR DELIVERY DEVICES AND METHODS

(75) Inventors: Jack Goodman, Ann Arbor, MI (US); William O'Neill, Maple Grove, MN (US); Alexander Chong, St. Louis Park, MN (US); William Bartkowski, Edina, MN (US)

(73) Assignee: Chong Corporation, Minneapolis, MN (US)

( * ) Notice: Subject to any disclaimer, the term of this patent is extended or adjusted under 35 U.S.C. 154(b) by 653 days.

(21) Appl. No.: 13/044,355

(22) Filed: Mar. 9, 2011

(65) Prior Publication Data

US 2012/0230659 A1 Sep. 13, 2012

(51) Int. Cl.

| | |
|---|---|
| ***A61H 33/06*** | (2006.01) |
| ***B01D 1/00*** | (2006.01) |
| ***B01D 3/00*** | (2006.01) |
| ***B05B 1/24*** | (2006.01) |
| ***F22B 1/28*** | (2006.01) |
| ***F24F 6/00*** | (2006.01) |
| ***F24F 6/08*** | (2006.01) |
| ***A24F 1/10*** | (2006.01) |
| ***B65D 37/00*** | (2006.01) |

(52) U.S. Cl.

CPC ..... *F22B 1/282* (2013.01)
USPC ..... 392/404; 392/394; 392/395; 131/330; 222/209

(58) Field of Classification Search

CPC ..... A01M 1/2077; F22B 1/28; F22B 1/282; F22B 1/284; F22B 1/287; F41H 9/06; C23C 14/26; C23C 14/243; A61L 9/03; A61L 2209/12; F24F 6/18; B44C 7/027; A61M 16/16; A61M 11/041; A24C 5/3406; B65D 1/32; B65D 47/2031; B05B 11/3032; B05B 11/043; B67D 1/0425; B67D 1/108; F16N 3/06; A01C 7/18

USPC ..... 392/386–406; 128/203.26, 203.27; 131/330; 222/206–215

See application file for complete search history.

(56) References Cited

U.S. PATENT DOCUMENTS 4,228,925 A 10/1980 Mendelovich
4,520,864 A * 6/1985 Katagiri et al. ..... 165/60

(Continued)

FOREIGN PATENT DOCUMENTS

CA 2562581 A1 10/2005
CN 89207339 5/1989

(Continued)

OTHER PUBLICATIONS

Materials Manual, Non-Metal—Jul. 1985.

(Continued)

*Primary Examiner* — Tu B Hoang
*Assistant Examiner* — Michael Hoang
(74) *Attorney, Agent, or Firm* — Cislo & Thomas, LLP

(57) ABSTRACT

In a vapor delivery device, a carrier or an expedient for an active ingredient is a liquid that can be vaporized by exposure to a concentrated, focused heating point using an efficient electrical power source. The device may have a vaporizing element and an electrical power source in a housing. A switch controls supply of electrical power to the vaporizing element from the electrical power source. A tube connects a liquid reservoir to the vaporizing element. A first valve, a second valve, and a pump are generally associated with the tube. A lever pivotally supported on or in the housing may be positioned to operate the first valve, the second valve, the pump and the switch, via pivoting movement of the lever. The device efficiently provides a uniform dose of vapor with each actuation.

10 Claims, 16 Drawing Sheets

(56) References Cited

U.S. PATENT DOCUMENTS

| | | | | |
|---|---|---|---|---|
| 4,531,912 | A * | 7/1985 | Schuss et al. | 433/80 |
| 4,641,053 | A | 2/1987 | Takeda | |
| 4,848,374 | A | 7/1989 | Chard et al. | |
| 4,945,929 | A | 8/1990 | Egilmex | |
| 4,945,931 | A | 8/1990 | Gori | |
| 5,042,470 | A | 8/1991 | Kanesaka | |
| 5,080,114 | A | 1/1992 | Rudolph et al. | |
| 5,095,921 | A | 3/1992 | Losee et al. | |
| 5,190,060 | A | 3/1993 | Gerding et al. | |
| 5,322,075 | A | 6/1994 | Deevi et al. | |
| 5,666,978 | A | 9/1997 | Counts et al. | |
| 5,743,251 | A | 4/1998 | Howell et al. | |
| 5,894,841 | A | 4/1999 | Voges et al. | |
| 6,040,560 | A | 3/2000 | Fleischlauer et al. | |
| 6,178,969 | B1 | 1/2001 | St. Charles | |
| 6,196,218 | B1 | 3/2001 | Voges | |
| 6,357,671 | B1 | 3/2002 | Cewers | |
| 6,443,146 | B1 | 9/2002 | Voges | |
| 6,532,965 | B1 | 3/2003 | Abhulimen et al. | |
| 6,854,461 | B2 | 2/2005 | Nichols et al. | |
| 7,238,057 | B2 | 7/2007 | Baranowski | |
| 7,364,427 | B2 | 4/2008 | Huang et al. | |
| 7,448,919 | B2 | 11/2008 | Baranowski | |
| 7,651,010 | B2 * | 1/2010 | Orzech et al. | 222/214 |
| 7,726,320 | B2 | 6/2010 | Robinson et al. | |
| 7,832,410 | B2 | 11/2010 | Hon | |
| 7,845,359 | B2 | 12/2010 | Montaser | |
| 2005/0016550 | A1 | 1/2005 | Katase | |
| 2005/0170303 | A1 | 8/2005 | Huang et al. | |
| 2006/0166564 | A1 | 7/2006 | Baranowski | |
| 2006/0196518 | A1 * | 9/2006 | Hon | 131/360 |
| 2007/0167084 | A1 | 7/2007 | Baranowski | |
| 2007/0267031 | A1 | 11/2007 | Hon | |
| 2008/0092912 | A1 | 4/2008 | Robinson et al. | |
| 2008/0230052 | A1 | 9/2008 | Montaser | |
| 2008/0247892 | A1 | 10/2008 | Kawasumi | |
| 2008/0257367 | A1 | 10/2008 | Paterno et al. | |
| 2008/0276947 | A1 | 11/2008 | Martzel | |
| 2009/0095311 | A1 | 4/2009 | Han | |
| 2009/0126745 | A1 | 5/2009 | Hon | |
| 2010/0031968 | A1 | 2/2010 | Sheikh et al. | |
| 2010/0200006 | A1 | 8/2010 | Robinson | |
| 2010/0200008 | A1 | 8/2010 | Taieb | |
| 2011/0005535 | A1 | 1/2011 | Xiu | |
| 2011/0011396 | A1 | 1/2011 | Fang | |
| 2011/0036346 | A1 | 2/2011 | Cohen et al. | |
| 2011/0041858 | A1 | 2/2011 | Montaser | |

FOREIGN PATENT DOCUMENTS

| | | | |
|---|---|---|---|
| CN | 2047485 | | 11/1989 |
| CN | 1135860 | | 11/1996 |
| CN | 1135860 | Y | 11/1996 |
| CN | 2293957 | Y | 10/1998 |
| CN | 1252961 | | 5/2000 |
| CN | 1284493 | | 2/2001 |
| CN | 1106812 | | 4/2003 |
| CN | 1530041 | | 9/2004 |
| CN | 2643681 | Y | 9/2004 |
| CN | 2648836 | Y | 10/2004 |
| CN | 1541577 | | 11/2004 |
| CN | 1575673 | | 2/2005 |
| CN | 2719043 | Y | 8/2005 |
| CN | 2777995 | Y | 5/2006 |
| CN | 1284493 | | 11/2006 |
| CN | 201379072 | Y | 11/2006 |
| CN | 1942114 | A | 4/2007 |
| CN | 200966824 | Y | 10/2007 |
| CN | 101084801 | A | 12/2007 |
| CN | 201067079 | Y | 6/2008 |
| CN | 201079011 | Y | 7/2008 |
| CN | 201273820 | | 7/2009 |
| CN | 201273820 | Y | 7/2009 |
| CN | 1196660 | A | 3/2010 |
| DE | 10051792 | A1 | 5/2002 |
| EP | 0295122 | A2 | 12/1988 |
| EP | 0342538 | A2 | 5/1989 |
| EP | 0545186 | A2 | 6/1993 |
| EP | 0824927 | A2 | 2/1998 |
| EP | 0845220 | A1 | 6/1998 |
| EP | 0893071 | A1 | 1/1999 |
| EP | 0970627 | A1 | 1/2000 |
| EP | 1618803 | A1 | 1/2006 |
| EP | 1736065 | A1 | 12/2006 |
| GB | 1528391 | A1 | 10/1978 |
| JP | 64-000498 | U | 1/1989 |
| JP | 07-506999 | | 5/1993 |
| JP | 06-114105 | A | 4/1994 |
| JP | 09-075058 | A | 3/1997 |
| UA | 47514 | | 7/2002 |
| WO | 97/48293 | A1 | 12/1997 |
| WO | 00/49901 | | 8/2000 |
| WO | 00/50111 | | 8/2000 |
| WO | 03/022364 | | 3/2003 |
| WO | 03/022364 | A1 | 3/2003 |
| WO | 03/034847 | A1 | 5/2003 |
| WO | 03/055486 | | 7/2003 |
| WO | 03/101454 | | 12/2003 |
| WO | 04/001407 | | 12/2003 |
| WO | 2004/001407 | | 12/2003 |
| WO | 2004/080216 | | 9/2004 |
| WO | 2004/095955 | | 11/2004 |
| WO | 2005/099494 | | 10/2005 |
| WO | 2006/082571 | | 8/2006 |
| WO | 2007/078273 | | 7/2007 |
| WO | 2007/131449 | | 11/2007 |
| WO | 2007/131450 | | 11/2007 |
| WO | 2008/055423 | | 5/2008 |
| WO | 2008/077271 | | 7/2008 |
| WO | 2008/130813 | | 10/2008 |
| WO | 2009/118085 | | 10/2009 |
| WO | 2009/135729 | | 11/2009 |
| WO | 2010/052323 | | 5/2010 |
| WO | 2010/091593 | | 8/2010 |
| WO | 2010/145805 | | 12/2010 |
| WO | 2011/010334 | | 1/2011 |

OTHER PUBLICATIONS

NPL—Intro Selecting Using Electronic Components Feb. 24, 2006.
NPL Manual Electric Engineers Mar. 2000.
NPL Manual Mechanical Designers Jan. 2002.
"What is a MOSFET, what does it look like, and how does it work?" May 24, 2004 www.techPowerUp.com.
Materials Manual. Non-Metal—Jul. 1985.

* cited by examiner

VAPOR DELIVERY DEVICES AND METHODS

BACKGROUND OF THE INVENTION

The field of the invention is vaporizing a liquid for inhalation. Various vaporizing devices have been used in the past. Still, disadvantages remain in the design and performance of vaporizing devices. These include variations in the dose of vapor delivered and leakage or performance failures unless the vaporizing device is maintained in an upright position during use, or during the packaging, shipping and storage of the device. In addition, with some vaporizing devices, the liquid may be subject to contamination, adulteration and/or evaporation under certain conditions.

Accordingly, it is an object of the invention to provide an improved vapor delivery system.

SUMMARY OF THE INVENTION

In one aspect, a vapor delivery device may have a vaporizing element and an electrical power source in a housing. A switch controls supply of electrical power to the vaporizing element from the electrical power source. A tube connects a liquid reservoir to the vaporizing element. A first valve, a second valve, and a pump are generally associated with the tube. A lever pivotally supported on or in the housing may be positioned to operate the first valve, the second valve, the pump and the switch, via pivoting movement of the lever. Other and further objects and advantages will become apparent from the following detailed description, which provides examples of embodiments of the invention. Persons of ordinary skill will readily be led to other additional examples of the invention that are not specifically described here, but are still intended to be within the scope of the invention.

DETAILED DESCRIPTION

Figure 1:
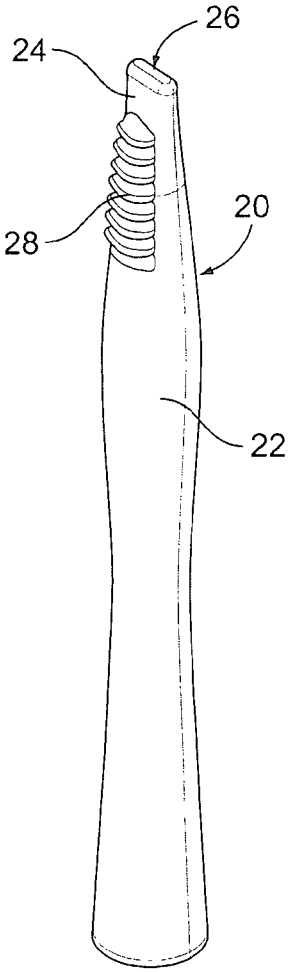
FIG. 1 is a perspective view of a new vaporizing device.
Figure 2:
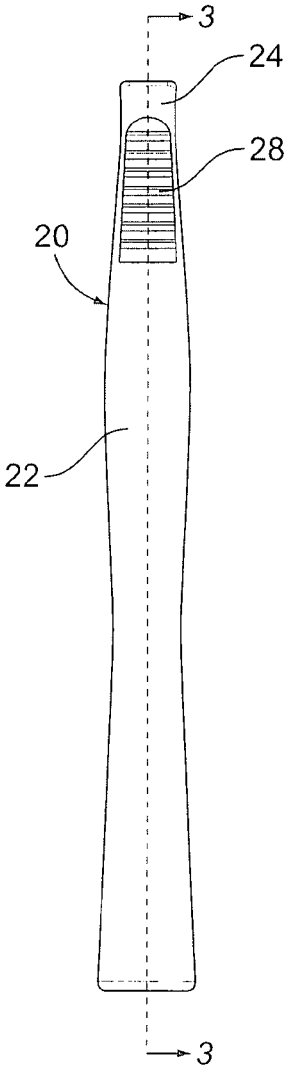
FIG. 2 is a top view of the device shown in FIG. 1.
Figure 3:
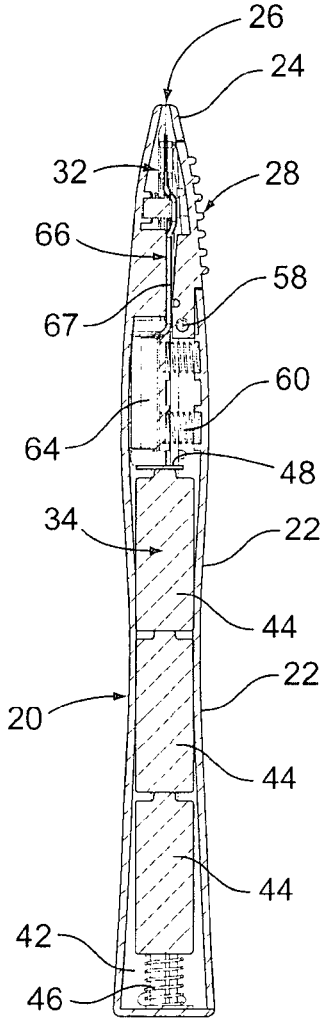
FIG. 3 is a section view taken along line 3-3 of FIG. 2.
Figure 4:
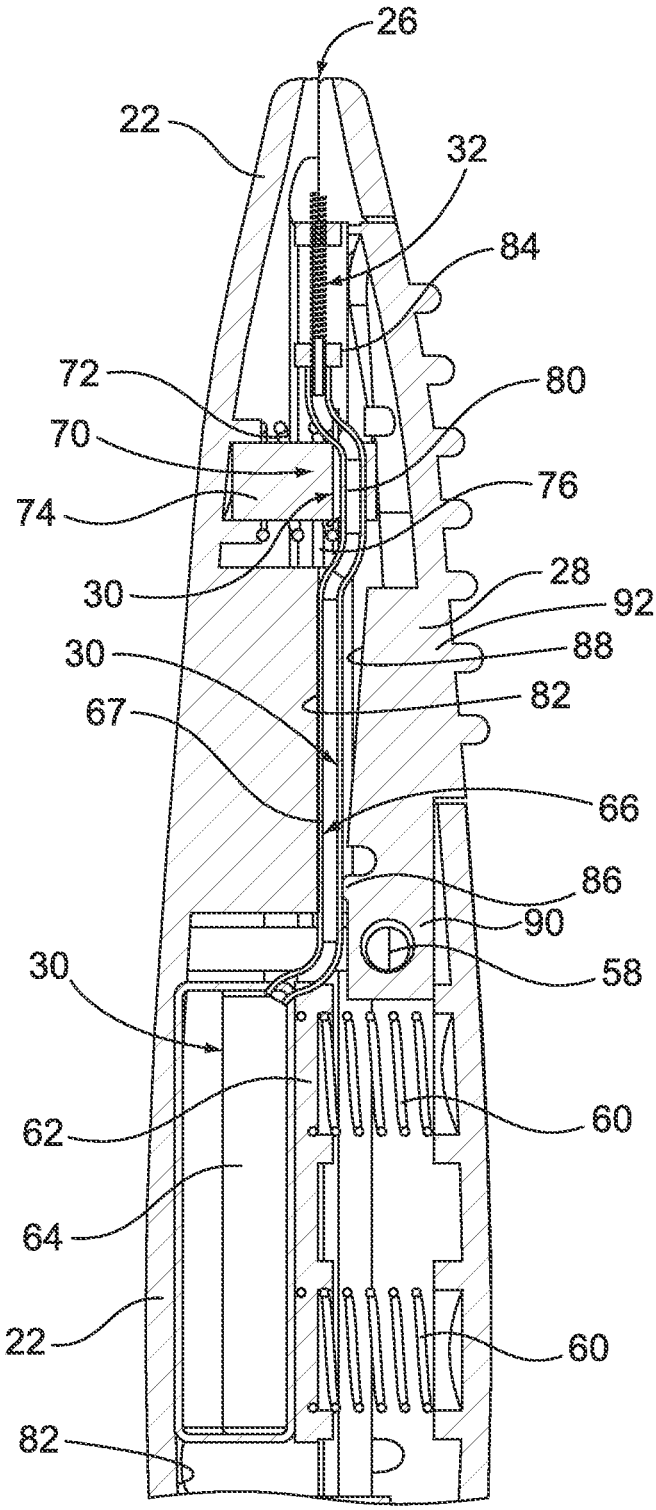
FIG. 4 is an enlarged detail section view of the upper section of the device.
Figure 5:
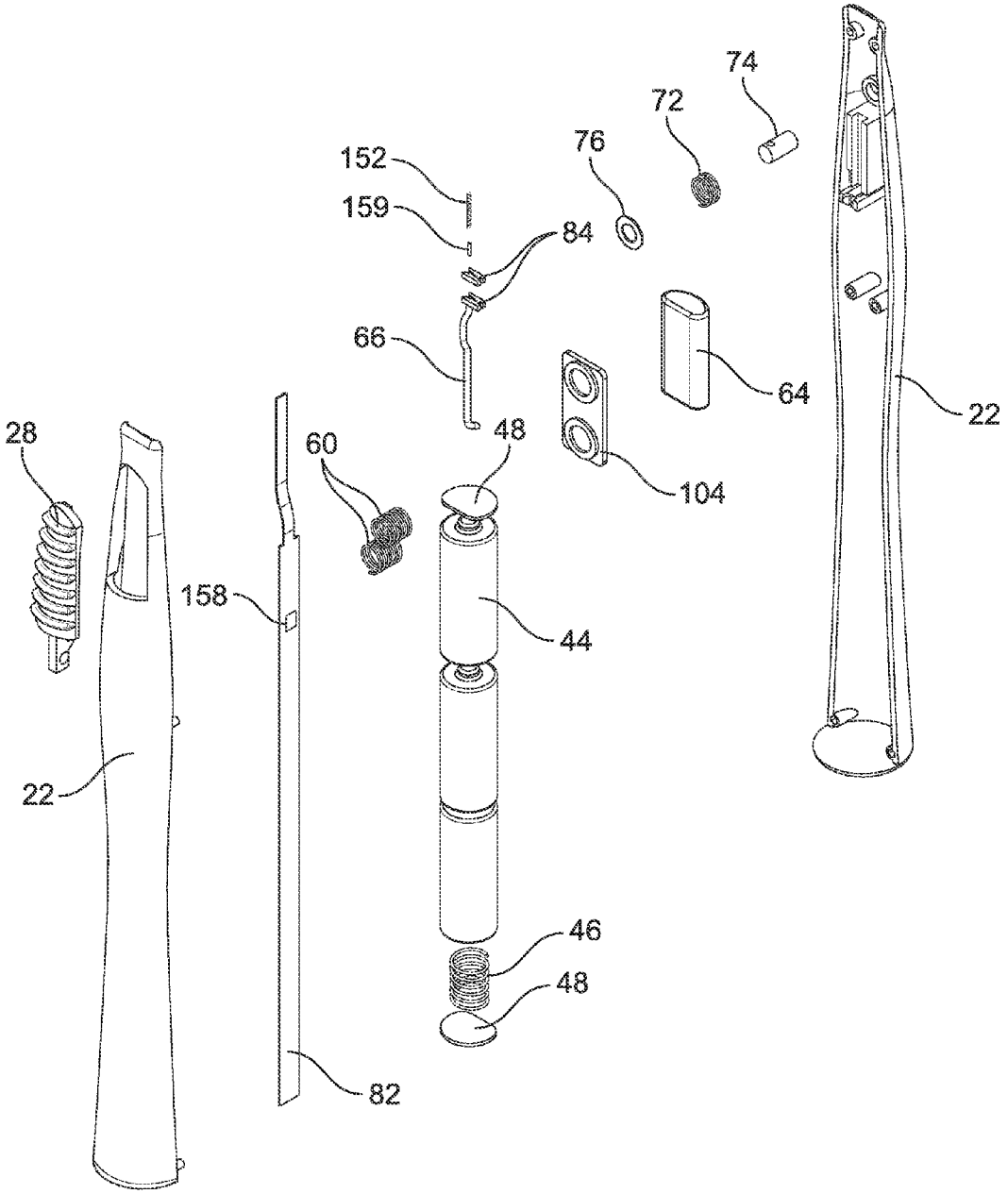
FIG. 5 is an exploded perspective view of the device shown in FIGS. 1-4.

Turning now in detail to the drawings, as shown in FIGS. 1 and 2, a vaporizing device 20 has an elongated housing 22 with a mouthpiece 24 and a lever 28 adjacent to a back or top end of the housing. A mouthpiece opening 26 extends into the mouthpiece 24. Referring further to FIGS. 3-5, the device 20 includes a liquid delivery system 30 and a vaporizing system 32, as well as an electrical power system 34. The electrical power system 34 may include batteries 44 within a battery compartment 42 of the housing 22, and with the batteries electrically connected to a flexible circuit board 82 via a spring 46 and contacts 48. As shown in FIG. 5, the housing may be provided with left and right sides, in a clamshell design. The lever 28 may be attached to the housing 22 at a pivot 58.

As shown in FIG. 4, the liquid delivery system 30, in the example shown, includes a resilient or flex wall liquid chamber or reservoir 64 connected via a tube 66 to a lever valve 70. The reservoir 64 may be a thin walled flexible pouch made of polyethylene film. The reservoir 64 is positioned between two rigid surfaces, with a plate 62 on one side and an inner wall of the housing 22 on the other side. Springs 60 within the housing 22 press on a plate 62, which in turn presses on the reservoir 64. This pressurizes the liquid in the reservoir.

Figure 6:
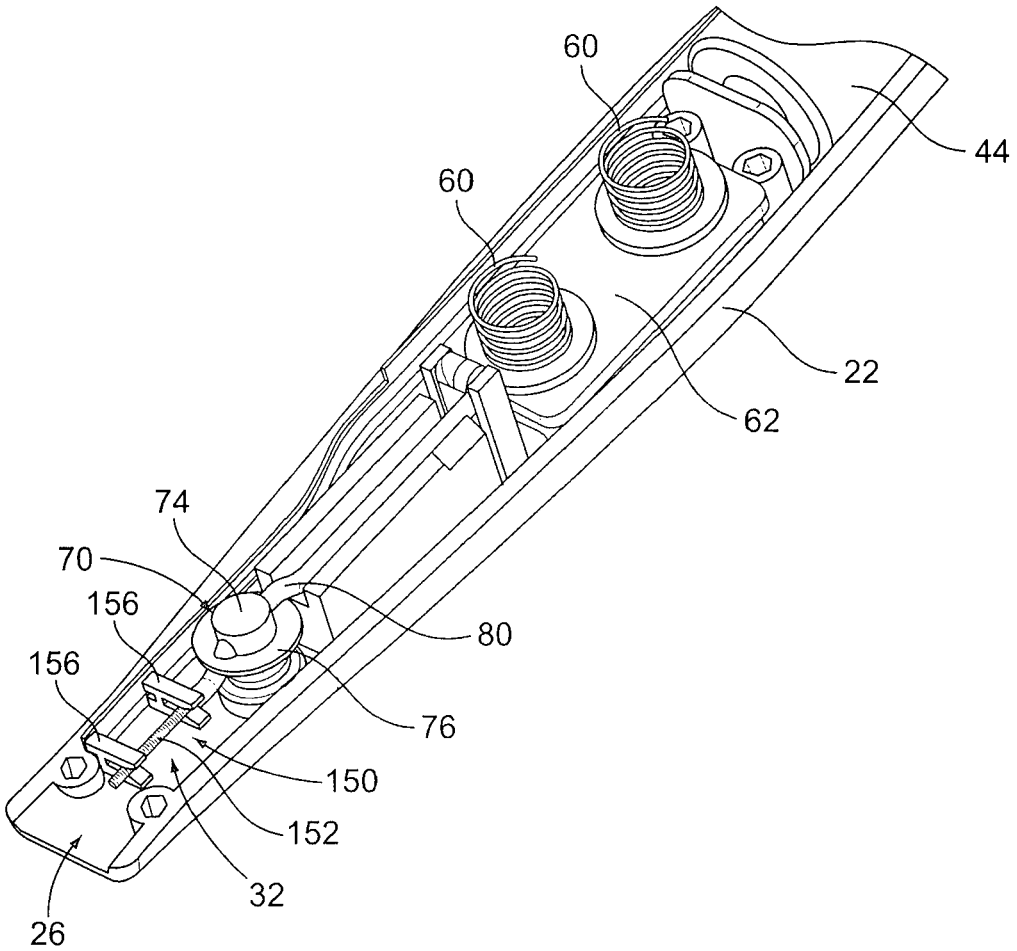
FIG. 6 is an enlarge perspective view of elements of the device shown in FIGS. 3-5.
Figure 7:
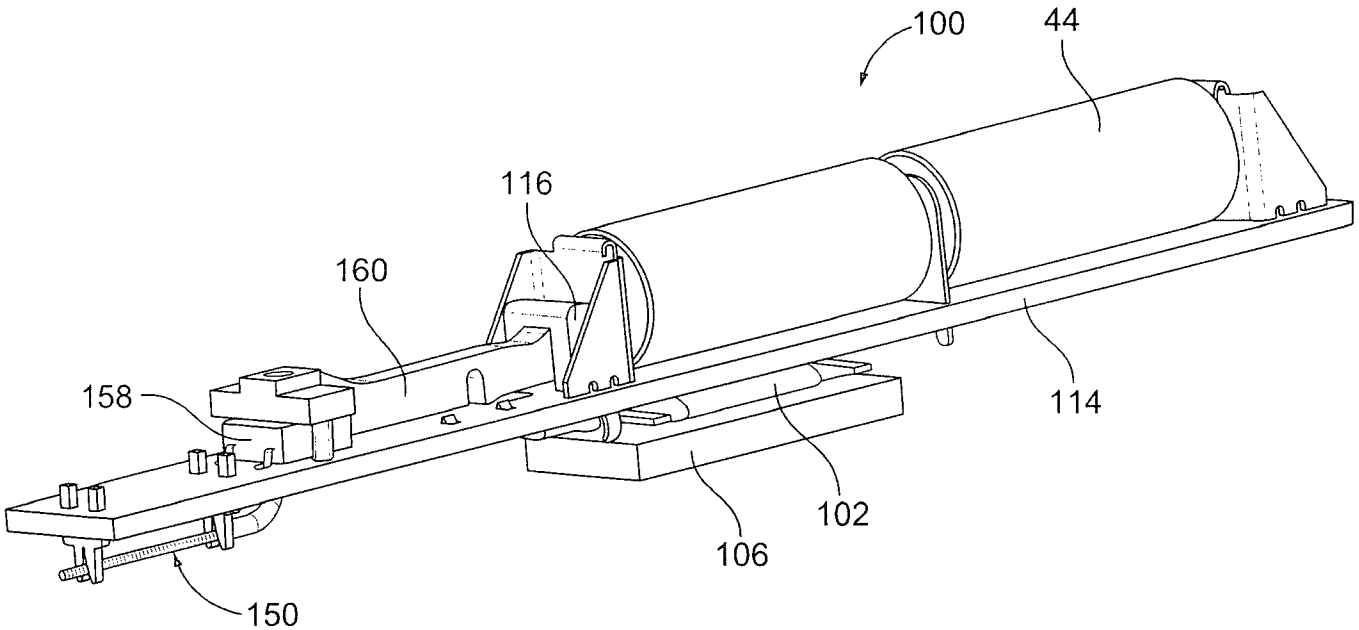
FIG. 7 is a perspective view of an alternative design, with the housing removed for purpose of illustration.

A tube 66 extends from the reservoir 64 to a lever valve 70 which may include a valve post 74, a valve spring 72 and valve washer 76. A valve section 80 of the tube 66 in this design extends through an opening the valve post 74, as shown in FIG. 6. The valve spring 72 urges the valve washer 76 against the valve section 80 of the tube pinching it closed.

Figure 14:
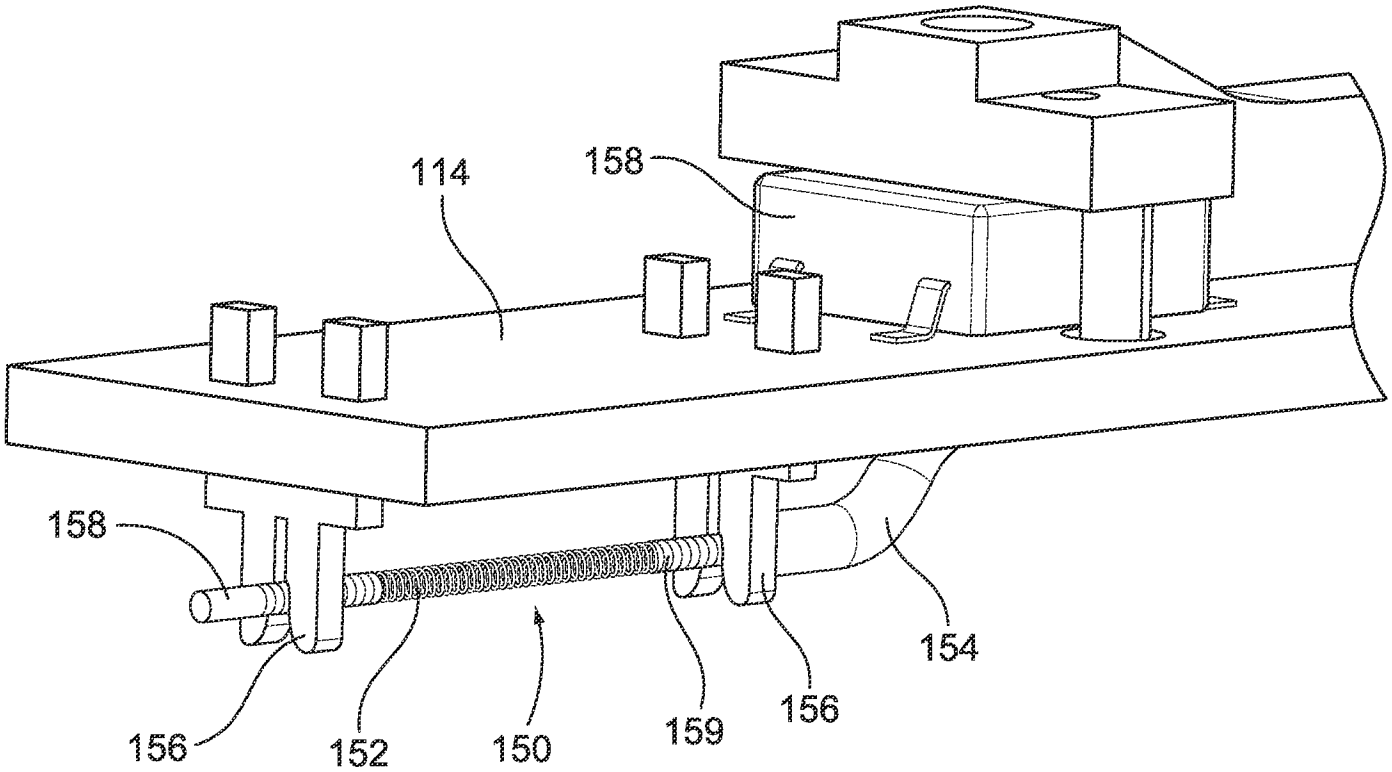
FIG. 14 is an enlarged perspective view of the vaporizing system shown in FIGS. 7-9.

Referring to FIGS. 4-6, the vaporizing system 32 includes a heater 150 which is electrically connected to the electrical power system 34. The vaporizing system 32 is also connected to, and receives liquid from, the liquid delivery system 30. The heater 150 may be an electrical resistance heater formed with by an open coil of wire 152, such as ni-chrome wire. In this design, the electric current is supplied to the coil 152 via connectors 156 on, or linked to, the flexible circuit board 82, which in turn in connected to the batteries 44. FIG. 14 shows the connectors 156 for providing electrical power to the heating element.

In use, the mouthpiece 24 is placed into the mouth and the user presses or squeezes the lever 28. The tube 66 is pre-filled or primed with liquid during manufacture. Referring to FIG. 4, as the lever 28 pivots down about the pivot 58, a pincher 86 located on a first section 90 of the lever 28 pivotally attached to the housing pinches the pump segment 67 of the tube 66 against an inside surface of the housing 20, adjacent to the pivot 58 and the reservoir 64. This temporarily closes off the tube 66 at the pincher 86. As the lever 28 continues to pivot down (or inward towards the centerline of the device) a ramp surface 88 on a second section 92 of the lever 28, flexibly attached to the first section 90 progressively squeezes the pump segment 67 of the tube 66 between the pincher 86 and the lever valve 70. This creates a squeegee type of movement which pumps liquid towards the lever valve 70 using a peristaltic action. As the lever 28 continues to pivot inwardly, posts on the lever press the valve washer 76 down against the force of the valve spring 72. This temporarily opens the lever valve 70 by allowing the valve section 80 of the tube 66 to open. With the valve section 80 of the tube open, and with liquid in the tube being pumped via the ramp surface 88, a bolus of liquid flows through the valve section 80 and the outlet segment 154 and into the wire coil 152.

An outlet segment 154 of the tube 66 extending out of the lever valve 70 towards the mouthpiece or back end of the device is inserted into the front end of a wire coil 152. Referring momentarily to FIG. 14, solid wire inserts 159 may he inserted into the ends of the wire coil 152 and the outlet segment 154 to provide internal support, so that they do not distort or collapse when pressed down into connectors 156. The outlet segment 154 at the front end of wire coil heater 152 provides liquid into the bore of coil with each actuation of the device 20.

The tube 66 is connected to the reservoir 64 with a liquid-tight connection so that liquid can only flow from the reservoir only through tube 66. The tube 66 may be a resilient, flexible material such that its inner lumen can in general be completely flattened when compressed, and then generally recover to its original shape when released. A pump segment 67 of the tube 66 is positioned beneath the lever 28 and a fixed surface inside of the housing, which optionally may be part of the circuit board 82 that power management circuitry, is on. Locating features 112 may be provide in, on, or through the circuit board 82 to ensure desired positioning is maintained. The lever 28 is retained by lever pivot 116 and can pivot through a controlled range of motion.

The constant positive pressure exerted on the reservoir 64 by the springs 60 pressurizes the liquid in the tube 66. However, since the tube 66 is pinched closed by the pincher 86, no liquid flows out of the reservoir when the lever is depressed and the lever valve is opening. Rather, the liquid already present in the tube 66 between the pincher 86 and the lever valve 70 provides the measured bolus which is uniformly delivered to the wire coil.

Figure 15:
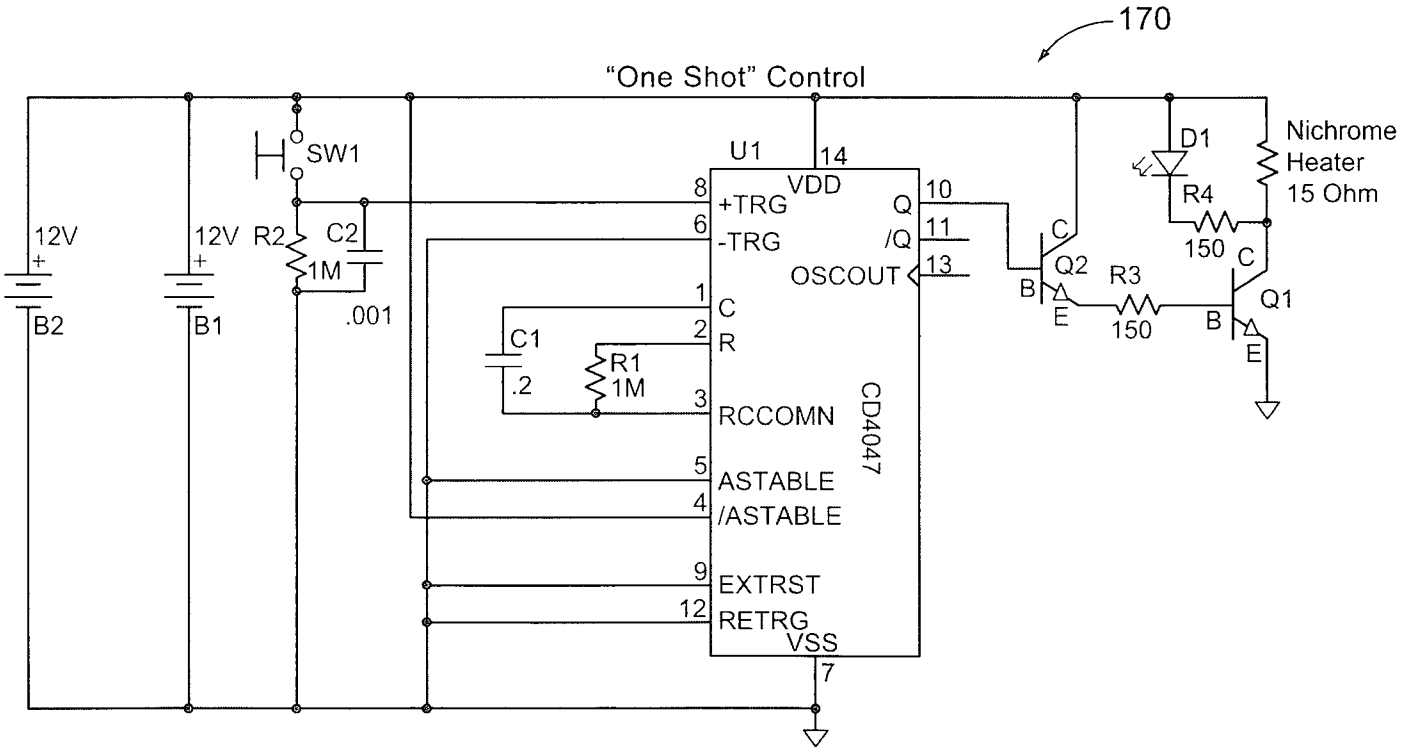
FIG. 15 is a schematic diagram of a "one-shot" circuit that may be used in the devices described below.

The downward movement of the lever 28 also closes a switch 158 linked to or located on the circuit board 82. Electric current then flows from the batteries 44, or other power source, to the wire coil 152. The wire coil heats up causing the liquid to vaporize. The current supplied to the wire coil, and the temperature of the wire coil when operating, may be regulated by the circuit board, depending on the liquid used, the desired dose, and other factors. The switch 158 may be positioned to close only when the lever 28 is fully depressed. This avoids inadvertently heating the wire coil. It also delays heating the wire coil until the bolus of liquid is moved into the wire coil via the pivoting movement of the lever, to help prolong battery life. A "one-shot" control circuit, for example as shown in FIG. 15 described below, may be used to limit the electric current delivery time interval regardless of how long the user holds the lever down. The power delivery system 34 is completely "off" in between uses. There is no drain on the battery during idle time. As a result, battery life is prolonged.

As is apparent from this description, the liquid delivery system 30, using a linear peristaltic pumping action, delivers a fixed, repeatable bolus of liquid to vaporizing system 32 with each actuation of the device 20. The liquid delivery system 30 further seals the reservoir 64 between actuations via the pincher 86, maintains the contents of the reservoir in a pressurized state, and controls electric power delivery to the vaporizing system 32. The liquid delivery system is designed so that as liquid is used, air is not introduced into the system.

The diameter and length of the wire coil 152 forms a cylindrical volume within the inside diameter of the coil that is sufficient to capture a single expressed dose of liquid from the liquid delivery system. The adjacent loops of wire of the wire coil 152 may also be positioned so that liquid surface tension holds the liquid within the bore of the coil. This allows the device 20 to be used in any orientation, since gravity is not needed to keep the released dose of liquid in place.

The use of an open coil offers the further advantage that the vapor may be generated and escape anywhere along the length of the coil, without inadvertently affecting vaporization of the balance of the bolus of liquid in the coil. The wire coil also provides a large surface area for heat transfer and minimizes energy loss resulting from heating ancillary components.

Upon application of electric power, liquid in the coil vaporizes and passes through gaps between coils. The coil can be sized and shaped and positioned in the housing so that the vapor generated can be entrained into an air stream drawn through the device 20 when the user inhales on the mouthpiece. Inhale here means drawing the vapor at least into the mouth.

FIGS. 7-13 show a second device embodiment 100 which may be similar to the device 20, but with the following differences. In the device 100, a foam pad 27 is compressed and inserted between a reservoir 64 and one of the rigid walls of the housing. Force exerted on the reservoir 64 by the foam trying to recover to its relaxed state exerts compressive force on the reservoir which maintains the liquid in the reservoir under pressure. The foam pad 27 may be used in place of the springs 60 shown in FIG. 4. The reservoir may alternatively be pressurized using a syringe with a spring biased plunger. With this design, the reservoir may optionally be provided as a replaceable cartridge.

Figure 8:
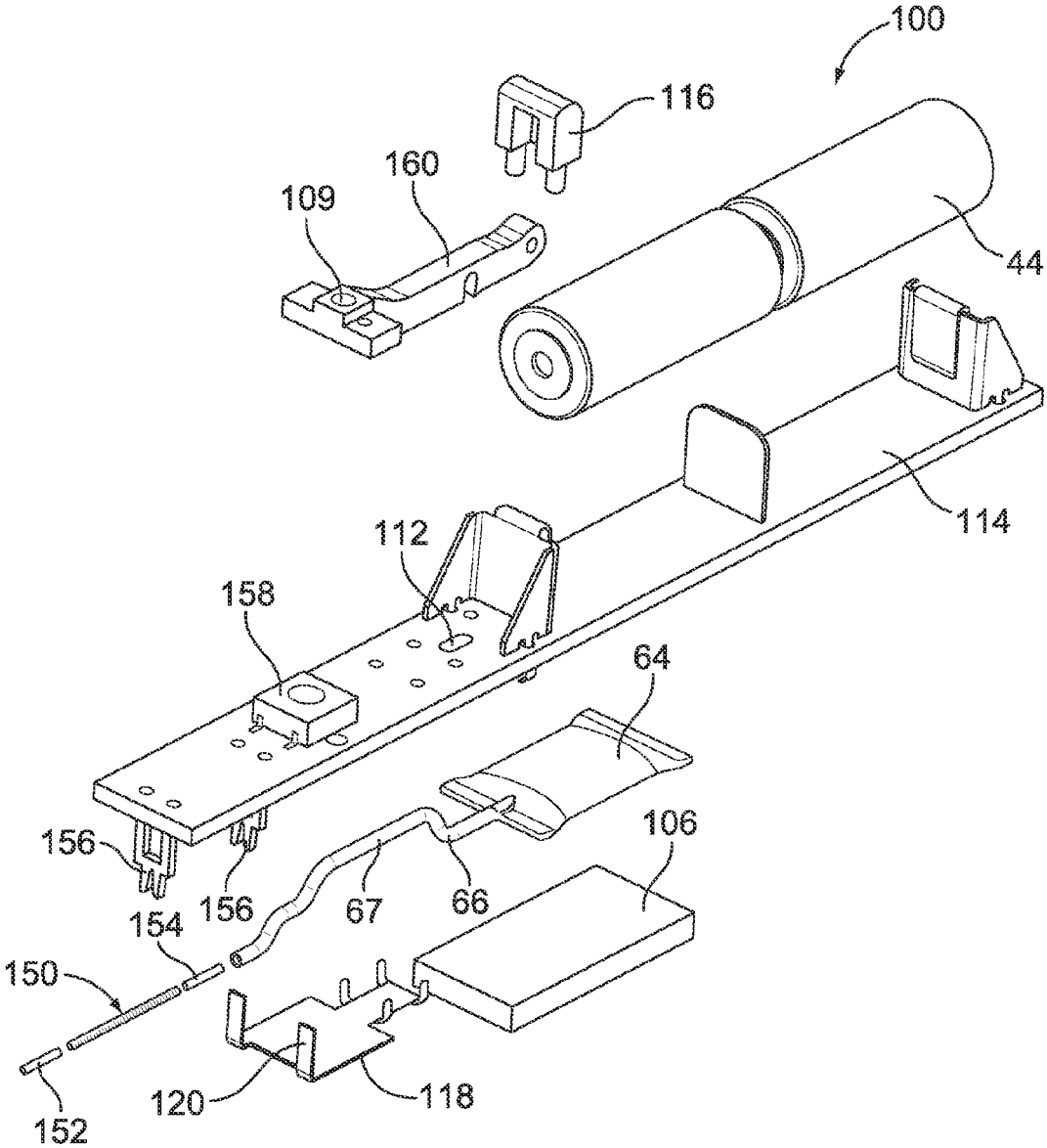
FIG. 8 is an exploded perspective view of the design shown in FIG. 7.
Figure 9:
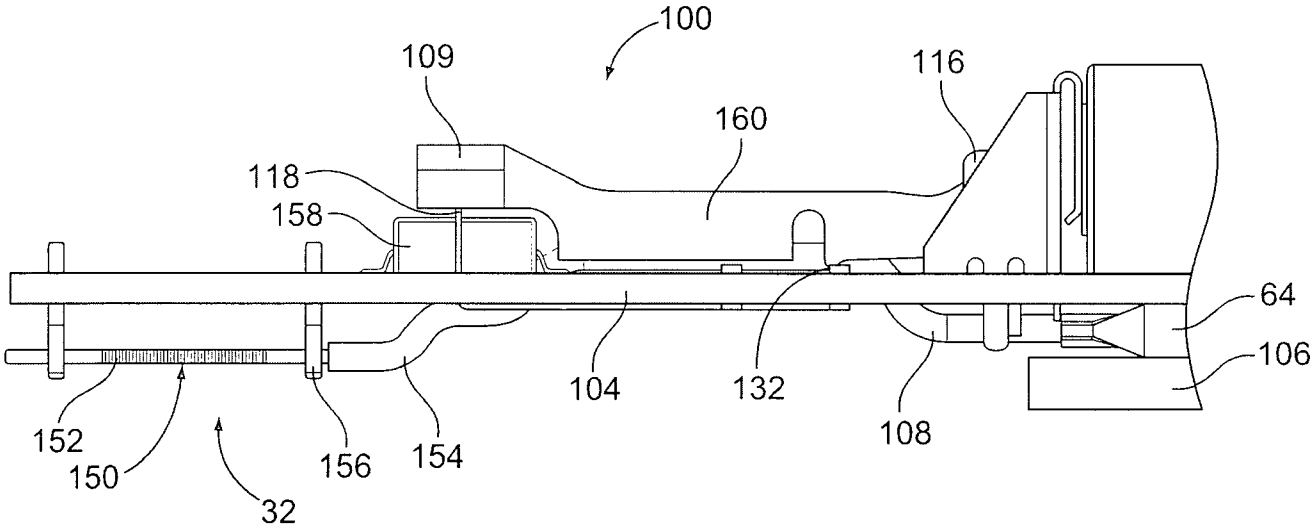
FIG. 9 is an enlarged side view showing details of elements shown in FIGS. 7 and 8.

As shown in FIG. 8, in the device 100, a lever valve 118 is provided (in place of the pincher 86 in the device 20) to compress the front end of the tube 66, preventing liquid from flowing out from the pressurized reservoir in between uses. The lever valve 118 may be a stamped sheet metal form soldered to a rigid circuit board 114.

Figure 11:
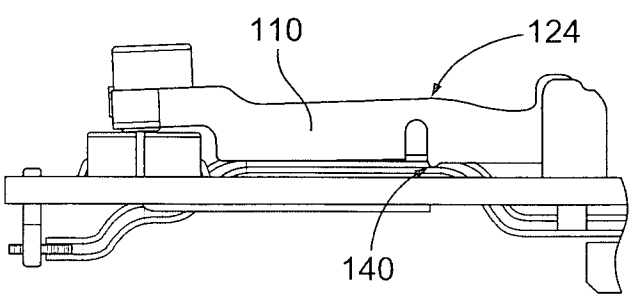
FIGS. 10-13 are side views of the device shown in FIGS. 7-9 illustrating sequential steps of operation.
Figure 10:
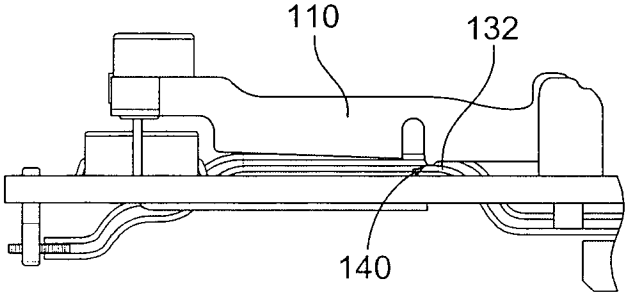
Figure 13:
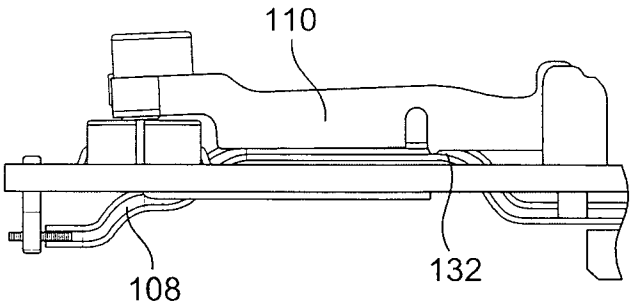

FIGS. 10-13 show the pumping action of the liquid delivery system in the device 100. When a dose of vapor is desired, the user places the mouthpiece in the mouth and inhales while pressing a button 109 on the lever 110, causing the lever to rotate downward (counter-clockwise). As the lever 110 initially rotates as shown in FIG. 10, a lever pinch projection 132 clamps or pinches the tube 66 closed at a pinch point 140, closing off the pressurized liquid reservoir. Continued rotation of lever 110 causes the lever 110 to flex at a flex point 124 having reduced thickness, as shown in FIG. 11. This allows over-travel rotation of the lever while the tube 66 remains closed off at the pinch point 140, without crushing the tube.

Figure 12:
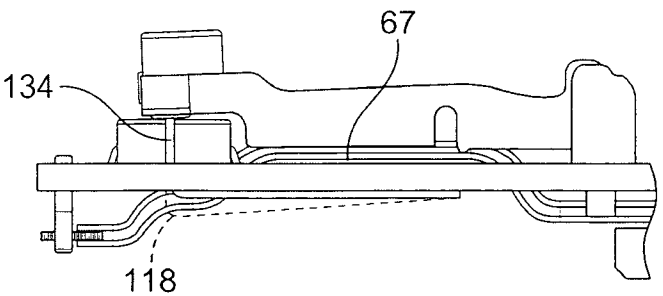

Further rotation of lever 110 then compresses the lumen of the pump segment 67 of the tube 66. This pumps liquid from the pump segment 67 towards the lever valve 118. This movement also moves projections on the lever which push valve flanges 120 down, deflecting and opening the lever valve 118, and allowing a pressurized bolus of liquid to move through the tube and into the vaporizing system 32. The dotted lines in FIG. 12 show the lever valve 118 deflected down and away from the bottom surface of the circuit board 114, to open the valve. Lastly, at end of the lever stroke, a lever switch protrusion contacts a switch 158, switching the power delivery system on.

When lever 110 is released, it pivots back up to its original position. As the lever returns, the lever valve 118 reseats first, sealing the back end of pump segment 67 of the tube 66 and preventing air from being drawn back into the pump segment. As the lever 110 continues to rotate clockwise, the pump segment 67 decompresses, creating a negative pressure within the tube lumen. Lastly, at pinch point 140 the tube 66 reopens, allowing pressurized liquid from the reservoir to enter, refilling pump segment with liquid to provide the next dose.

The volume of liquid expressed with each stroke can he controlled by selection of desired pump segment 67 tube diameter and length. Maintenance of a positive pressure on the liquid reservoir ensures that the system always stays primed with liquid, and that "short shots" resulting from air bubbles in the tube do not occur. Furthermore, sealing of the vaporizer system with a valve such as the valve 70 or 118 that is only actuated at the time of delivery, and positive pressure dispensing prevents inadvertent leakage of liquid irrespective of orientation of the device during storage or use.

FIG. 15 is a schematic diagram for a "one-shot" circuit 170 that delivers a fixed time interval of electric current to the heater 150 regardless of how long the lever is depressed by the user. In FIG. 15, CD4047 is a CMOS low power monostable/astable multivibrator available for example from Texas Instruments. U1 is a common CD4047 which operates from a 12V battery voltage with very low quiescent current drain. When pushbutton SW1 is depressed, U1 is triggered, Q (pin 10) goes high and C1 is rapidly charged to near the supply voltage through a FET within U1. At the same time, resistor R1 is switched to a logical "0" state and immediately begins discharging capacitor C1 with the time constant of 1/RC.

A wide range of pulse durations may be selected. Using a typical ni-chrome wire coil, pulse durations ranging from approximately 0.2 to 2 seconds are sufficient to fully vaporize the bolus of liquid. When the voltage on pin 3 reaches the threshold for logic "0" (~⅓ supply voltage), the logic levels switch and Q (pin 10) returns to a logic low level. Q2 is an emitter follower that provides current amplification to enable Q1 to be fully saturated during the desired current pulse. D1 and R4 provide a visual indication of the heater current. R2 is a "pull down" resistor for SW1, and C2 prevents induced noise from falsely triggering the circuit. Other choices of IC may be employed such as the Toshiba TC7WH123 depending upon battery voltage, package size, and cost.

Figure 16:
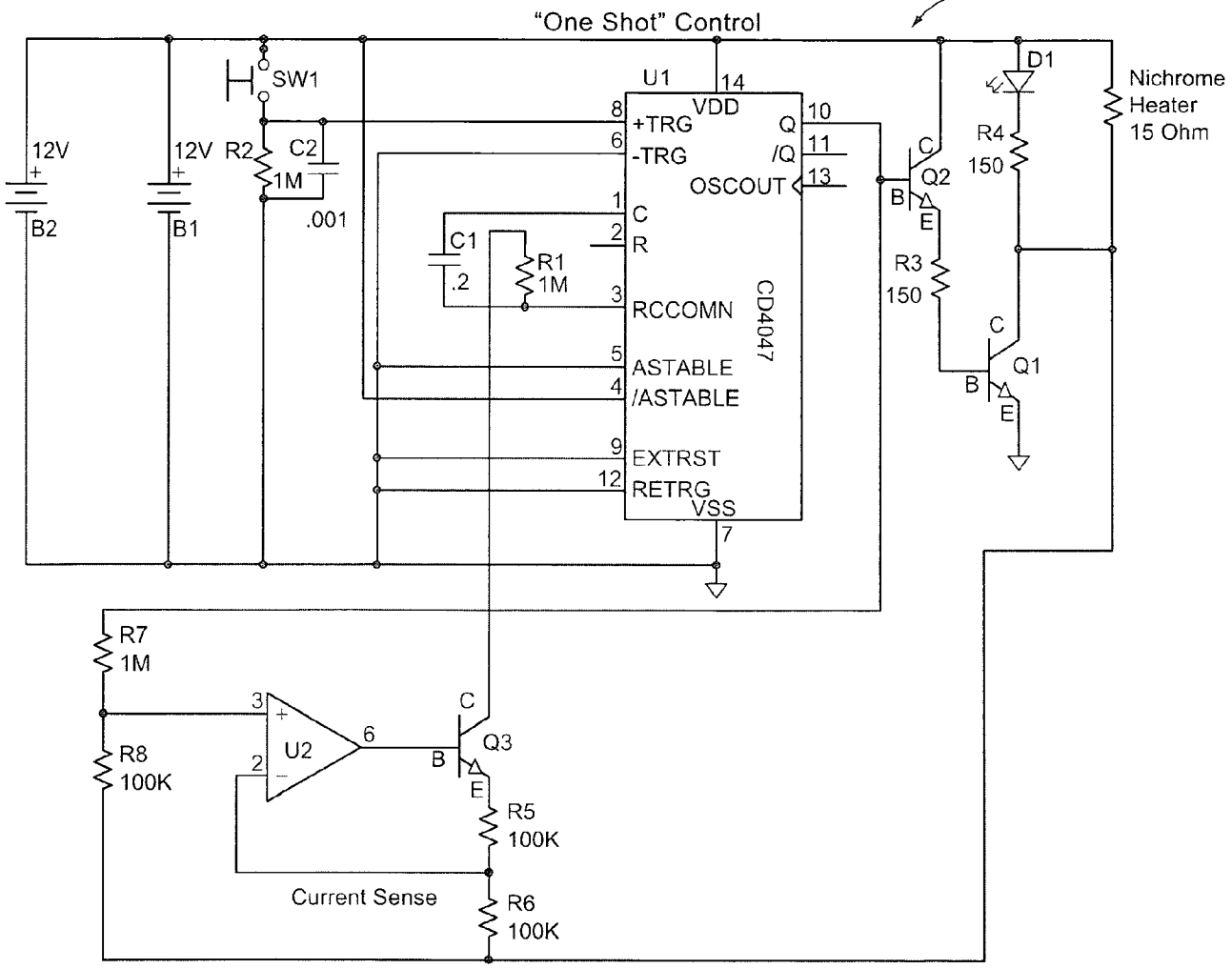
FIG. 16 and FIG. 17 are schematic diagrams of similar modified circuits.

The battery voltage gradually decreases over the lifespan of the device. For many applications, the circuit described in FIG. 15 provides the necessary control. However, more precise metering of the medicament may be accomplished by increasing the current pulse duration as the current decreases over the discharge life of the battery. In the circuit 172 shown in FIG. 16, an additional OP amp IC serves as a voltage controlled current source. The input voltage is sampled from Pin 10 of U1. A constant current is generated in Q3 and used to discharge the timing capacitor, C1, at a constant rate. Once the voltage across C1 reaches the logic threshold, CD 4047 trips and the output pulse width is complete. As the battery voltage decreases the constant current generated in Q3 decreases, causing the time to discharge C1 to increase. This lengthens the output pulse to maintain a relatively constant heater power per inhalation cycle as the battery voltage declines over the lifetime of the device. The various current setting and sense resistor values may be adjusted to provide optimal performance. Other circuits may be employed to provide the same function such as voltage to frequency converters.

Figure 17:
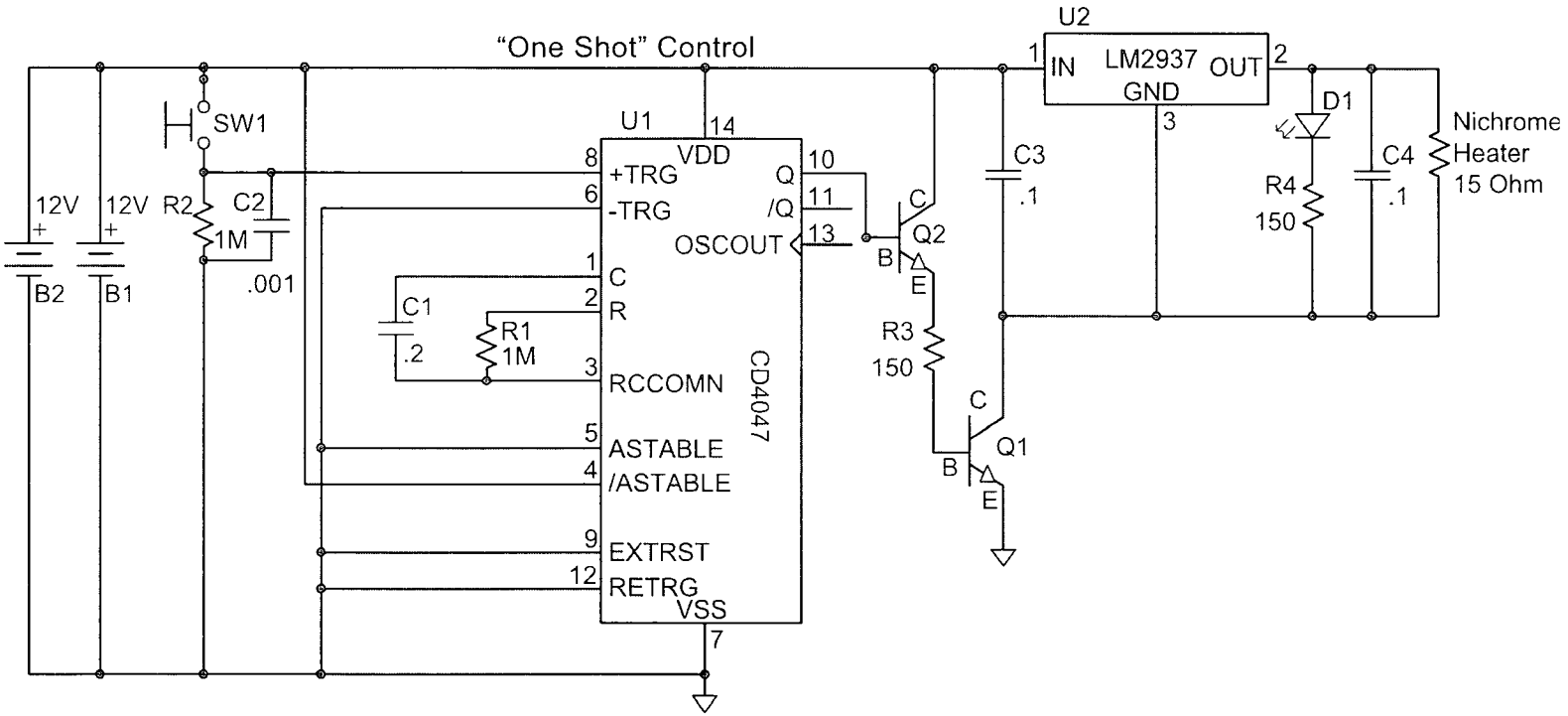

FIG. 17 shows another circuit 174 where a voltage regulator U2 is inserted between the output transistor Q1 and the heater filament. This keeps the filament voltage constant throughout the battery life. The regulated voltage may be chosen to optimize the heater operation near end of life. A low dropout regulator is desired to maximize the lifespan before regulation is no longer maintained. A simple linear regulator is shown, but a high efficiency, switching regulator may also be employed to improve efficiency. The pulse duration is maintained as described above or an equivalent "one shot" circuit and the heater current is kept constant by the voltage regulator.

In another alternative design, the electrical power system 34 may be configured to provide consistent power by timing the power to provide the minimum energy needed to vaporize the liquid. The power system may also be programmed to do this. For example, the electrical power system may be programmed to power the source down to the voltage required to vaporize the liquid, so as to extend its useful life. Here, the power source may include a capacitor that builds, retains and provides a charge necessary to vaporize the liquid to be vaporized, again, so as to extend the useful life of the power source.

Figure 18:
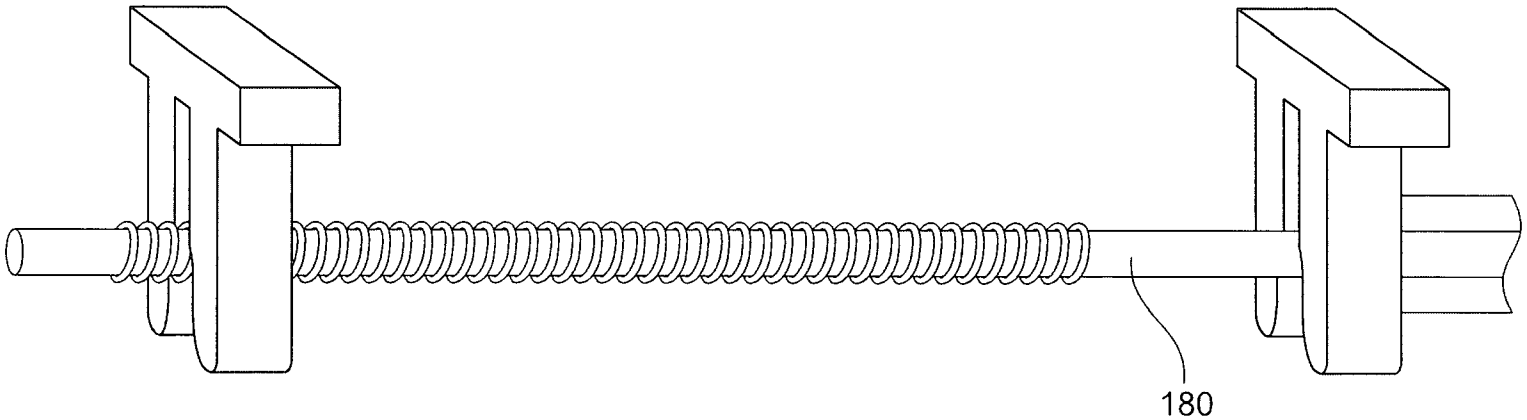
FIG. 18 is an enlarged side view of an alternative vaporizing element.

In an additional alternative design shown in FIG. 18, the liquid to be atomized is delivered into a small diameter tube 180 via capillary action, as distinct from providing the liquid via pressure into the heating coil, where it is stabilized for vaporization due to surface tension. The tube 180 can be glass, polyaniline or metal, e.g., stainless steel. A heating element such as ni-chrome wire can be coiled around the tube, coiled into the tube or inserted into a tube in a V-shape so as to heat the entire volume of liquid at the same time.

Figure 19:
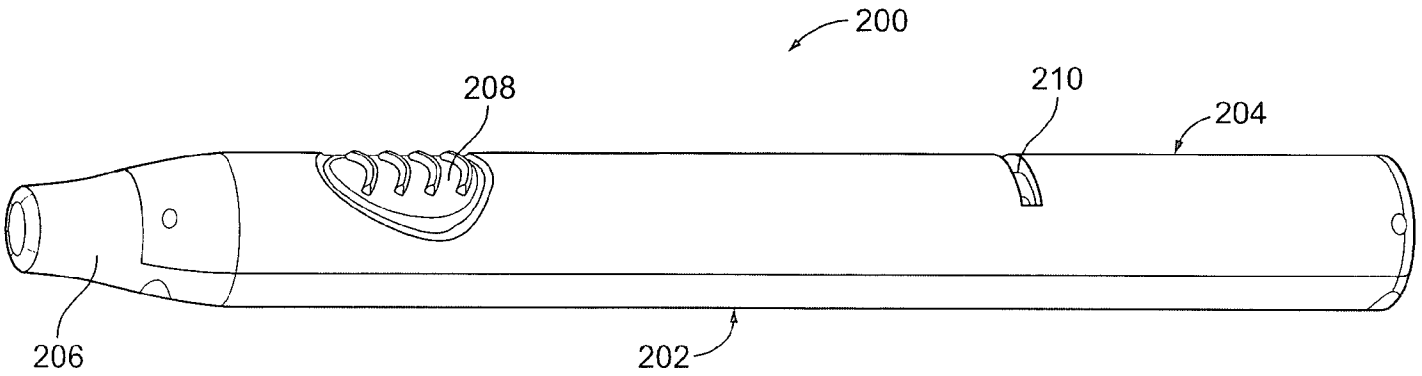
FIG. 19 is a perspective view of an alternative vaporizing device.
Figure 20:
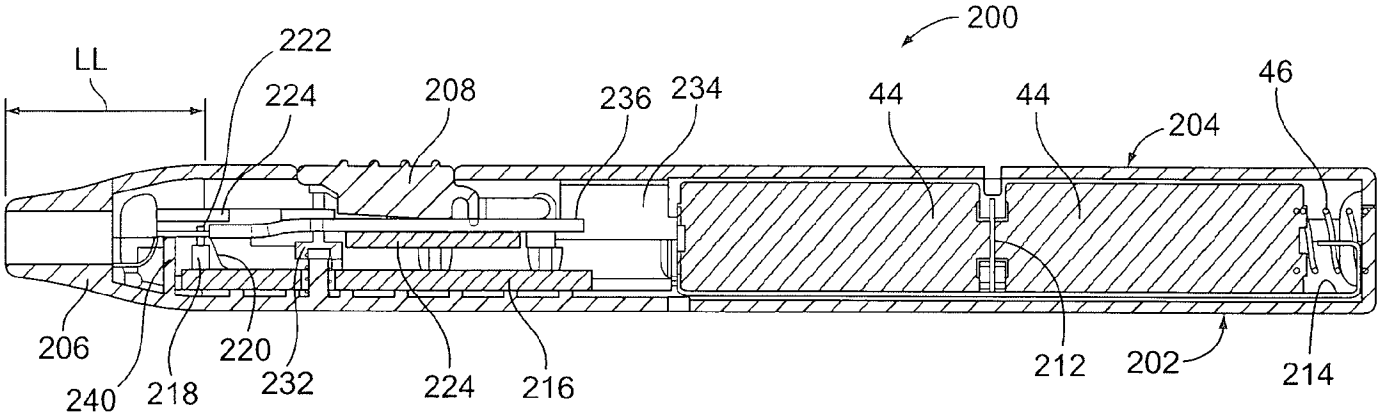
FIG. 20 is a section view of the vaporizing device shown in FIG. 19.
Figure 21:
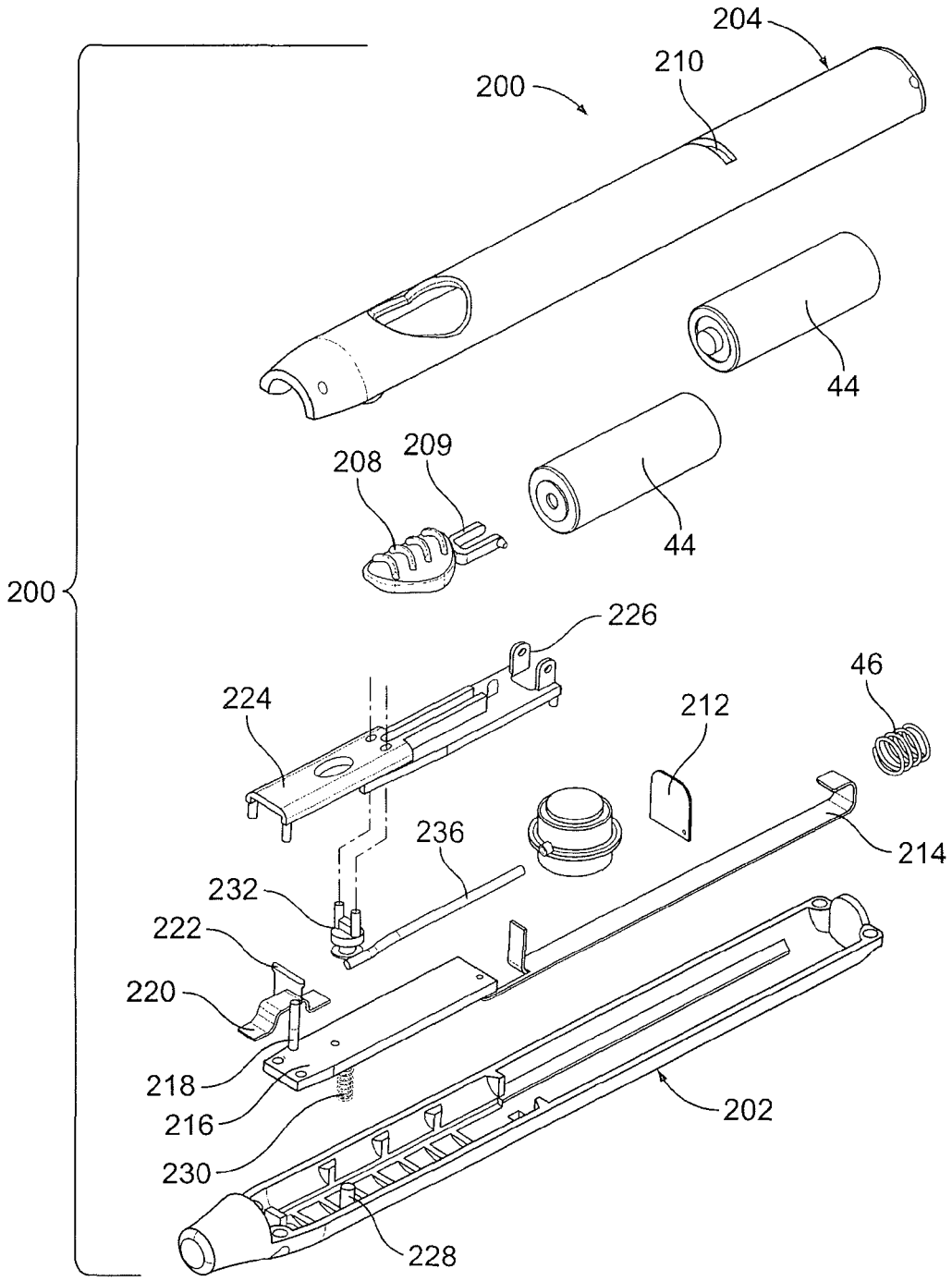
FIG. 21 is an exploded perspective view of the vaporizing device shown in FIGS. 19 and 20.

FIGS. 19-22 show an alternative vaporizing device 200 having a housing formed from a base 202 including a mouthpiece 206, and a cover 204 attached to the base 202. Pivot arms 209 on a button 208 are pivotally attached to pivot posts 226 on a bridge 224, as shown in FIG. 21. The radius 244 of the pincher 238 can flex when the tube 236 is compressed. The bridge 224 has pins for securely attaching it to the base 202. The positive electrode of each battery 44 are held into contact with center contact 212 by a spring 46. A positive conductor strip connects the center contact to a printed circuit board 216.

Brass posts or similar contacts are attached to the printed circuit board 216 and to opposite ends of the coil 222. The button 208 has a pincher arm 238 positioned to pinch and close off flow in a tube 236 connecting a liquid reservoir to an outlet location on, adjacent to or overlying the wick 220. The tube 236 may be held in place by molded in tube clips 242 on the bridge 224. Arms 233 on a normally closed pinch valve 232 extend up through openings in the bridge 224. A valve spring 230 around a post 228 holds the valve 232 into the normally closed position. A bottom surface of the valve 232 may act as a switch with the printed circuit board 216, or actuate a separate switch on the printed circuit board 216, to switch on electrical current to the coil 222 when the button 208 is pressed.

In use, the vaporizing device 200 operates on the same principals as described above, with the following additions. A slot 210 may be provided in the housing to accommodate an insulating tab. The insulating tab is installed during manufacture and prevents electrical contact between the center contact 212 and the batteries. As a result, the device cannot be inadvertently turned on during shipping and storage. Battery life is therefore better preserved. Before operating the vaporizing device 200 for the first time, the user pulls the tab out of the slot 210. As shown in FIGS. 19 and 20, the mouthpiece is round. The dimension LL in FIG. 20 between the coil 222 and the mouthpiece tip may be minimized to 15, 10 or 5 mm. The liquid reservoir may have a volume exceeding 0.8 or 1.0 ml to allow foam compression to pressurize the pump. In the device 200, the liquid, supplied from the reservoir via the tube 236 is not delivered into the coil 222. Rather the liquid is delivered onto to the wick 220. The heating coil 222 abuts the wick 220 and heats the wick, which then vaporizes substantially all of the liquid on or in the wick.

Figure 22:
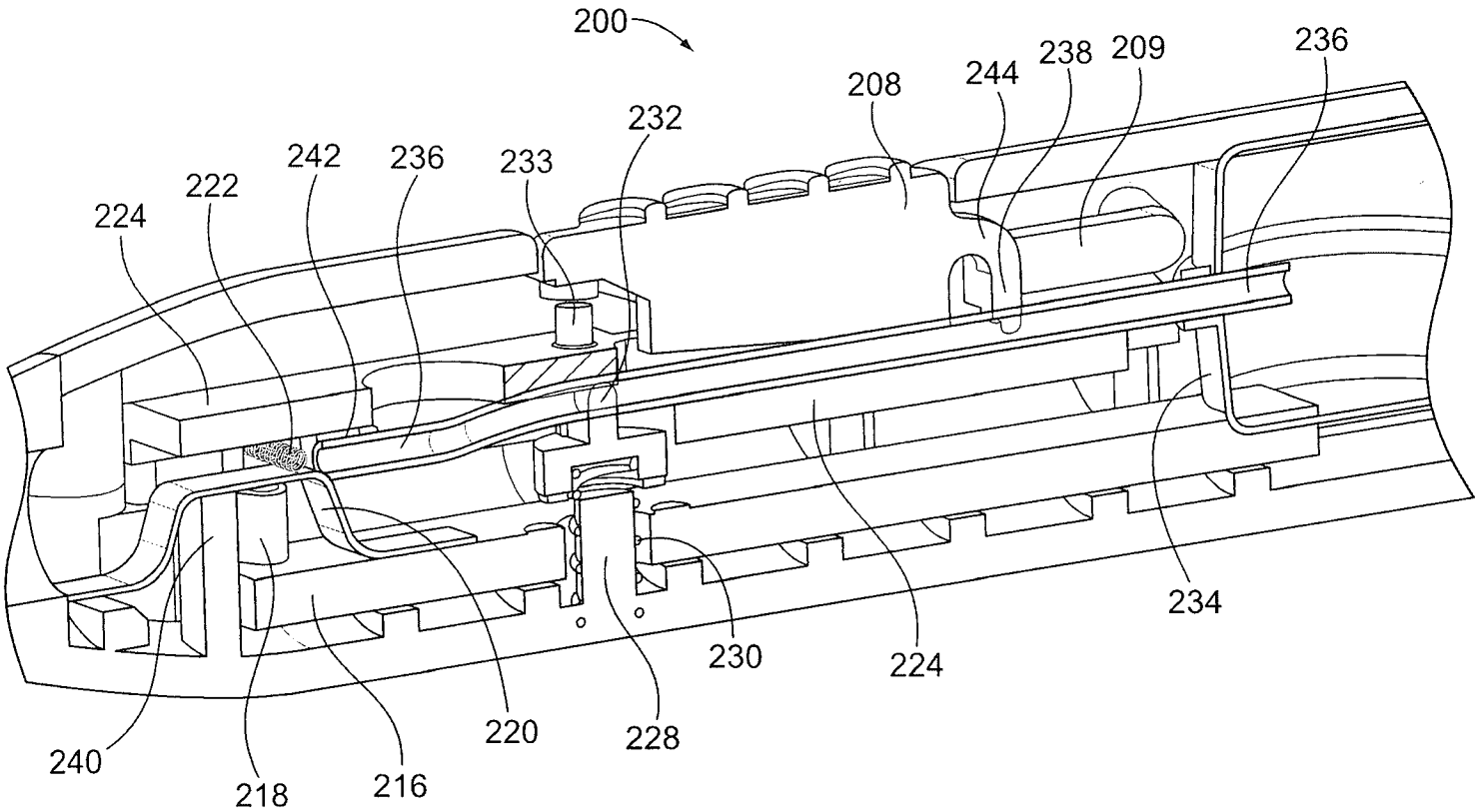
FIG. 22 is an enlarged perspective view of elements shown in FIG. 20.

Referring to FIG. 22, a wick 220 extends from the printed circuit hoard 216 up to a vaporizing coil 222 and optionally over a raised wall 240. The wick may be a strip or sheet of ceramic tape 220 that serves as a wick and a heat sink. The wick 220 is positioned between the heating element, such as the vaporizing coil 222, and the outlet of the tube 236. The wick 220 may rest on top of the heating element, or be positioned adjacent to it, and the tube outlet may also be on top of the heating element and the wick 220 (when the device 200 is in the upright position, with the button 208 on top).

In each of the vaporizing devices described above, the open coil heater 152 or 222 of e.g., ni-chrome wire may be encased in a porous ceramic material, so that the vapor produced when the fluid is atomized must pass through the ceramic material in order to be ingested. The ceramic material can be manufactured with techniques that control the size of the pores through which the vapor will pass. This can help to regulate the size of the vapor molecules or droplets produced for inhalation. By controlling the amount of electrical power and the duration of power to the coil heater, the heater continues to vaporize the fluid at the heater until the vapor droplets or particles are small enough to pass through the ceramic material, effectively utilizing all the fluid delivered to the coil and controlling the dose in addition to regulating the molecule size. By regulating the size of the vapor molecule produced, the vaporizing devices can be used with more precision and with fluids and medicaments that require carefully controlled dosages particle sizes. In some cases, smaller molecules may be advantageous as they can be inhaled more deeply into the lungs, providing better a more effective delivery mechanism.

The wire coil heater may alternatively be encased in a heat resistant fabric-like material, so that the vapor must pass through the fabric to be ingested. The fabric can be manufactured with a desired mesh opening size, better regulate the size of the vapor particles delivered by the vaporizer. By, by controlling the amount of electrical power and the duration of power to the heater, the heater continues to vaporize the fluid delivered to the heater until the vapor particles are small enough to pass through the mesh of the fabric. This can help to effectively atomize and deliver all the fluid delivered to the heater, with little or no waste, in turn controlling the dose.

Although the switch 158 is described above as a mechanical contact switch, other forms of switches may optionally be used, including switches that optically or electrically sense the movement of position of an element, or a switch that senses the presence of liquid in the heater 150. In addition, though the lever and pinch valves are shown as clamping type of valves, other forms of mechanically or electrically operated valves may be used. Similarly, the peristaltic pumping action created by the pivoting movement of the lever may be optionally replaced with alternative forms of pumping or fluid movement. Various types of equivalent heating elements may also be used in place of the wire coils described. For example, solid state heating elements may be used. The heating element may also be replaced by alternative vaporizing elements, such as electro-hydrodynamic or piezo devices that can convert liquid into a vapor without heating. Thus, multiple embodiments and methods have been shown and described. Various modifications and substitutions may of course be made without departing from the spirit and scope of the invention. The invention, therefore, should not be limited except by the following claims and their equivalents.

The invention claimed is:

1. A vapor delivery device comprising:
- a housing;
- a vaporizing element in the housing;
- an electrical power source in the housing;
- a switch for switching on and off electrical power to the vaporizing element from the electrical power source;
- a liquid reservoir in the housing;
- a tube connecting the liquid reservoir to the vaporizing element;
- a first valve, a second valve, and a pump associated with the tube, with the pump between the first and second valves; and
- a lever pivotally supported on or in the housing and positioned to operate the first valve, the second valve, the pump and the switch, via pivoting movement of the lever with the first valve comprising a projection on the lever positioned to pinch the tube closed as the lever is pivoted to actuate the device.

2. The device of claim 1 with the reservoir having flexible sidewalls and further comprising one or more spring elements pressing on the reservoir.

3. The device of claim 1 with the pump comprising an angled surface on the lever that squeezes a section of the tube as the lever pivots.

4. The device of claim 1 wherein the first valve is normally open and the second valve is normally closed, with movement of the lever closing the first valve and opening the second valve to provide a dose of vapor.

5. The device of claim 1 with the vaporizing element comprising a coil of wire with the tube adapted to supply a bolus of liquid into the coil of wire with movement of the lever.

6. The device of claim 1 with the lever including a first section pivotally attached to the housing and a second section flexibly attached to the first section, and with the first section of the lever actuating the first valve and with the second section of the lever actuating the pump.

7. The device of claim 1 further comprising a battery compartment within the housing and with a flexible circuit board extending from the battery compartment to the vaporizing element.

8. The device of claim 1 further comprising a rigid circuit board within the housing, with the switch and the vaporizing element attached to the board, and with the lever pivotally attached to the board.

9. The device of claim 8 with the second valve supported by the rigid circuit board.

10. A vapor delivery device comprising:
- a housing;
- a vaporizing element in the housing;
- an electrical power source in the housing;
- a switch for switching on and off electrical power to the vaporizing element from the electrical power source;
- a liquid reservoir in the housing;
- a tube connecting the liquid reservoir to the vaporizing element;
- a first valve, a second valve, and a pump associated with the tube, with the pump between the first and second valves; and
- a lever pivotally supported on or in the housing and positioned to operate the first valve, the second valve, the pump and the switch, via pivoting movement of the lever with the second valve including a post with the tube passing through an opening in the post and a spring urging a washer into contact with the tube.

* * * * *